US006102343A

United States Patent [19]

Grimesey et al.

[11] Patent Number: 6,102,343

[45] Date of Patent: Aug. 15, 2000

[54] STEP AND LIFT REFUSE LINER REMOVAL SYSTEM

[76] Inventors: Christopher A. Grimesey; Thomas E. Murdoch, both of 7459 Pearl Rd., Middleburg Hts., Ohio 44130

[21] Appl. No.: 09/114,360

[22] Filed: Jul. 14, 1998

[51] Int. Cl.[7] ..... B65B 67/12

[52] U.S. Cl. ..... 248/95; 220/908

[58] Field of Search ..... 248/95, 132; 220/908, 220/908.1, 495.01, 495.04, 262

[56] References Cited

U.S. PATENT DOCUMENTS

| | | | |
|---|---|---|---|
| 269,625 | 12/1882 | Blake | 248/132 X |
| 496,917 | 5/1893 | Sweger | 220/908 X |
| 1,140,867 | 5/1915 | Bates | 248/95 X |
| 1,286,368 | 12/1918 | Lucas . | |
| 3,306,486 | 2/1967 | Martino . | |
| 4,140,257 | 2/1979 | Peterson | 220/908 X |
| 4,363,417 | 12/1982 | Rhoades et al. . | |
| 4,440,321 | 4/1984 | Campbell et al. . | |
| 4,763,809 | 8/1988 | Miller et al. . | |
| 4,883,189 | 11/1989 | Lobbert | 220/908 X |
| 4,890,760 | 1/1990 | Nicoll, Sr. et al. . | |
| 4,991,500 | 2/1991 | Knapp | 220/908 X |
| 5,031,796 | 7/1991 | Schafer et al. | 220/908 X |
| 5,125,526 | 6/1992 | Sumanis | 220/908 X |
| 5,163,579 | 11/1992 | Jones | 220/908 X |
| 5,348,222 | 9/1994 | Patey | 220/908 |
| 5,375,732 | 12/1994 | Bowers et al. . | |
| 5,390,812 | 2/1995 | Spiro . | |
| 5,690,247 | 11/1997 | Boover | 220/908 X |
| 5,803,303 | 9/1998 | Timm et al. | 220/908.1 X |

*Primary Examiner*—Ramon O. Ramirez
*Attorney, Agent, or Firm*—John D. Gugliotta

[57] ABSTRACT

A step and lift refuse liner removal system is disclosed, consisting of a conventional refuse container main housing. A conventional refuse liner rests on a support plate, located inside the main housing, above the bottom of the main housing. Air holes in the support plate facilitate air flow throughout the main housing, thus reducing the vacuum between the refuse liner and the side walls of the main housing. A dual fulcrum and curved lever system permits the operator to lift the support plate by pressing down on a foot bar located outside the main housing near the ground. As such, the present invention facilitates the easy and effortless removal of a conventional refuse liner. A set of foot pads are provided to enable the operator to restrict the movement of the main housing relative to the ground.

8 Claims, 7 Drawing Sheets

STEP AND LIFT REFUSE LINER REMOVAL SYSTEM

BACKGROUND OF THE INVENTION

1. Field of the Invention

The present invention relates generally to refuse containers, and, more particularly, to a step and lift refuse liner removal system.

2. Description of the Related Art

Trash receptacles, also known as refuse containers, are used in almost every home in the United States. These receptacles take many forms, from small, indoor waste paper baskets to large, outdoor garbage cans. A large majority of these refuse containers utilize a replaceable liner that is placed inside of a metal or plastic housing. The user fills the refuse liner with garbage, and when the liner is full, the user removes the liner from the housing and disposes of it, placing a new liner in the housing. Examples of such refuse containers include U.S. Pat. No. 4,763,809, issued in the name of Miller et al., U.S. Pat. No. 4,440,321, issued in the name of Campbell et al., U.S. Pat. No. 4,363,417, issued in the name of Rhoades et al, U.S. Pat. No. 3,306,486, issued in the name of Martino et al., and U.S. Pat. No. 1,286,368, issued in the name of Lucas.

While use of refuse liners is a sanitary and efficient way to dispose of garbage over time, removal of the refuse liner from the housing of the permanent container can be difficult and dangerous to one's health.

Traditionally, the refuse liner must be lifted up and over the rim of the container. The vertical forces required to accomplish this are significant, causing injury to many users. The weak and infirm, along with the young and elderly, find it difficult to generate such vertical forces upon the refuse liner.

The bending and tugging at the refuse liner is a tedious and bothersome task, due in part to the vacuum created between the refuse liner and the sides of the container. Devices in the previous art attempt to address this problem by providing vacuum release means. U.S. Pat. No. 5,375,732, issued in the name of Bowers et al., discloses air conduits directed within the container side walls. U.S. Pat. No. 4,890,760, issued in the name of Nicoll et al., discloses a valve mounted in the central portion of the container.

Another problem associated with refuse containers that use refuse liners is the lifting of the container during removal of the liner. U.S. Pat. No. 5,390,812, issued in the name of Spiro, discloses footpads that retract along the sides of the container and can be extended to lay flat against the ground, thus providing a means of retaining the container against the floor using one's foot.

Another problem with refuse containers that use refuse liners is associated with the cleaning process. Cleaning of such devices is messy and difficult, necessitating that the user bend over and reach into the bottom of the device to clean the occasional spills and refuse that slip past the refuse liner.

A search of the prior art did not disclose any patents that read directly on the claims of the instant invention. Consequently, a need has been felt for providing an apparatus and method which overcomes all of the problems cited above.

SUMMARY OF THE INVENTION

It is therefore an object of the present invention to provide an improved step and lift refuse liner removal system that facilitates the easy and efficient removal of traditional refuse liners from a refuse container by reducing the stress placed on the users wrists, elbows, shoulders, neck and back, and stabilizing the position of the container during liner removal, while reducing the vertical force needed to lift the refuse liner by reducing the vacuum normally created between the liner and the sides of the container, raising the bottom surface on which the liner rests during refuse placement, and utilizing the downward force created by the foot during a stepping motion to provide vertical force assistance to the user during removal of the liner.

Briefly described according to one embodiment of the present invention, a step and lift refuse liner removal system is disclosed, consisting of a conventional refuse container main housing. A conventional refuse liner rests on a support plate, located inside the main housing, above the bottom of the main housing. Air holes in the support plate facilitate air flow throughout the main housing, thus reducing the vacuum between the refuse liner and the side walls of the main housing. A dual fulcrum and curved lever system permits the operator to lift the support plate by pressing down on a foot bar located outside the main housing near the ground. As such, the present invention facilitates the easy and almost effortless removal of a conventional refuse liner.

It is another object of the present invention to provide a device that reduces the amount of vertical force required to lift a traditional refuse liner from a refuse container, such as a kitchen refuse container or outdoor garbage can, by providing a lifting mechanism internal to the container that is activated by downward pressure of the foot. This feature creates the benefit of reducing stress on the lower back created by excessive vertical forces needed to remove traditional refuse liners.

It is another object of the present invention to provide a device that utilizes a stepping motion of the foot to provide a significant amount of the force needed to lift a liner from the present invention, thus creating the benefit of reducing stress and strain on hands, wrists, elbows, shoulders and backs. In addition, bending and tugging at the refuse liner to remove it is greatly eliminated.

It is another object of the present invention to provide a device that reduces the amount of vertical force required to lift a traditional refuse liner from a refuse container, by providing air holes along the internal surface area of the present invention. This feature reduces the vacuum created between traditional trash containers and the refuse liner as the refuse liner is removed. As such, the reduced vacuum creates the benefit of reducing the suction created by the vacuum, and reduces the force required to remove a traditional refuse liner.

It is another object of the present invention to provide a device that reduces the stress placed on a user's back by providing a false bottom. This feature creates the benefit of reducing the total vertical distance that the liner must be lifted to clear the top of the present invention, thus reducing the strain on the lower back of the user. Another benefit of this feature is that individuals with less than average strength can lift a refuse liner from the present invention. These individuals include the young, the elderly, the sick and the infirm.

It is another object of the present invention to facilitate ease of liner removal by providing an integrated foot holder. This feature provides the benefit of assisting the user in keeping the present invention in contact with the floor while the liner is removed, thus eliminating required extra force and inconvenience created by a device that lifts off the floor during liner removal.

It is another object of the present invention to provide a device that is designed for easy cleaning.

DESCRIPTIVE KEY

| | | | |
|---|---|---|---|
| 11 | step and lift refuse liner removal system | 150 | lifting assembly |
| | | 160 | fulcrum point |
| 15 | refuse liner | 165 | fulcrum hole |
| 20 | main housing | 170 | fulcrum protrusion |
| 30 | top | 180 | fulcrum retention means |
| 40 | bottom | 190 | fulcrum protrusion hole |
| 50 | side walls | 200 | first internal arm |
| 60 | anterior wall | 205 | second internal arm |
| 70 | posterior wall | 220 | external arm |
| 80 | foot pad | 230 | threaded hole |
| 85 | floor | 240 | foot bar |
| 90 | refuse orifice | 250 | external arm receiving orifice |
| 100 | support plate | 260 | foot bar hole |
| 110 | vacuum hole | 270 | foot bar retention means |
| 120 | support plate stand | 280 | traction generating means |
| 130 | support plate guide | | |
| 140 | lifting slot | | |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

In order to describe the complete relationship of the invention, it is essential that some description be given to the manner and practice of functional utility and description of a step and lift refuse liner removal system 10.

The best mode for carrying out the invention is presented in terms of its preferred embodiment, herein depicted within the FIGS. 1 through 10.

1. Detailed Description of the Figures

Figure 1:
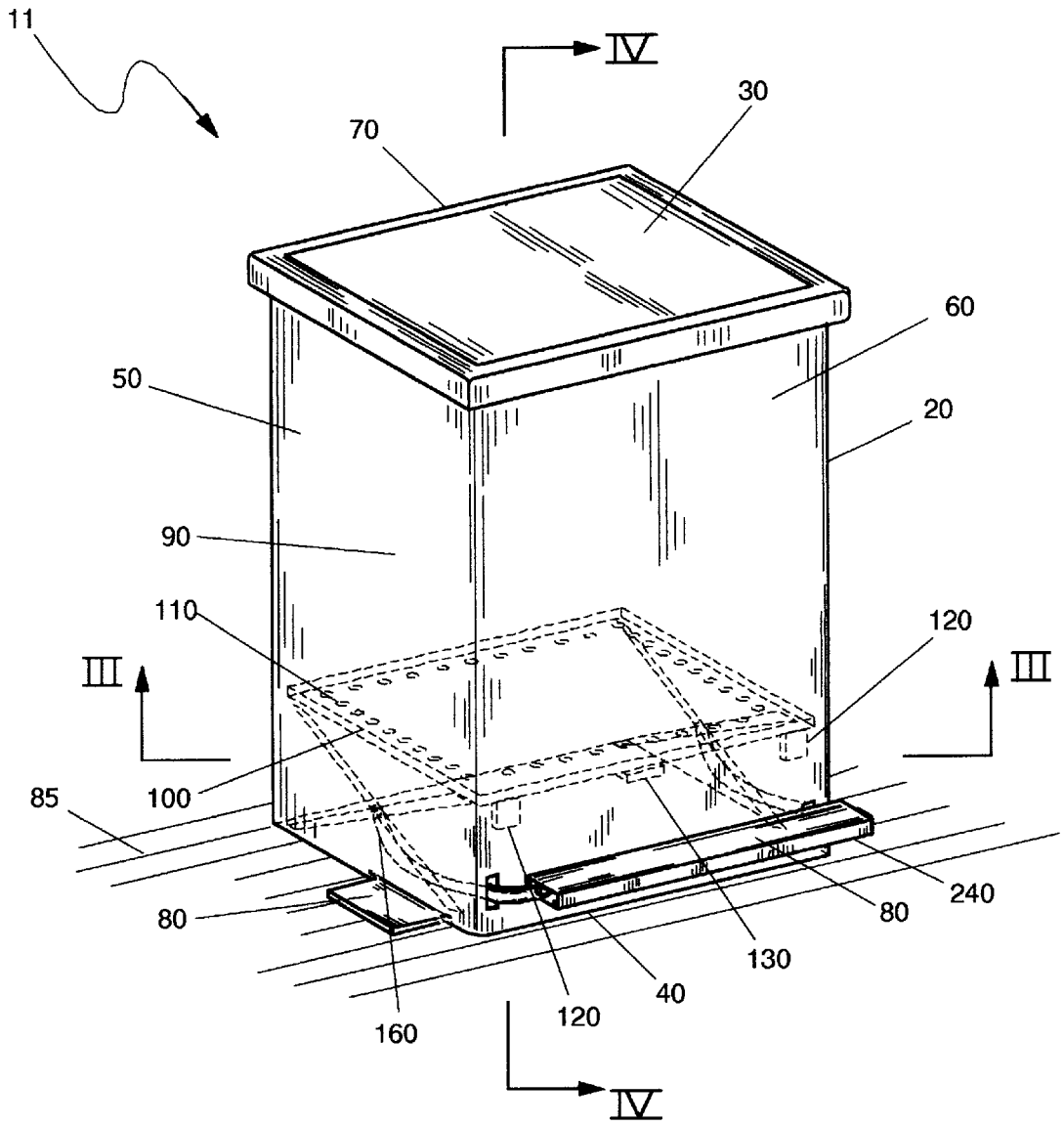
FIG. 1 is an elevational front perspective of the preferred embodiment of a step and lift refuse liner removal system 10.

Referring now to FIG. 1, a step and lift refuse liner removal system 11 is shown, according to the present invention, comprises a main housing 20. It is envisioned that the main housing 20 is of a vertically elongated, upstanding rectangular configuration, having an open top 30 and a closed bottom 40, and generally impervious side walls 50, an anterior wall 60 and a posterior wall 70, attached to the bottom along their common edges to form a receptacle for receiving a refuse liner 15 that holds trash or debris therein. The main housing 20 is made of a plastic material, however, it should be noted that other conventional material may be used for making the same. It should further be noted that the size of the main housing 20 may be varied to accommodate the use thereof in different applications, i.e., in commercial and residential application. It is envisioned that other styles and configurations of the main housing 20 can be easily incorporated into the teachings of the present invention, and only one particular configuration shall be shown and described for purposes of clarity and disclosure and not by way of limitation of scope.

Figure 2:
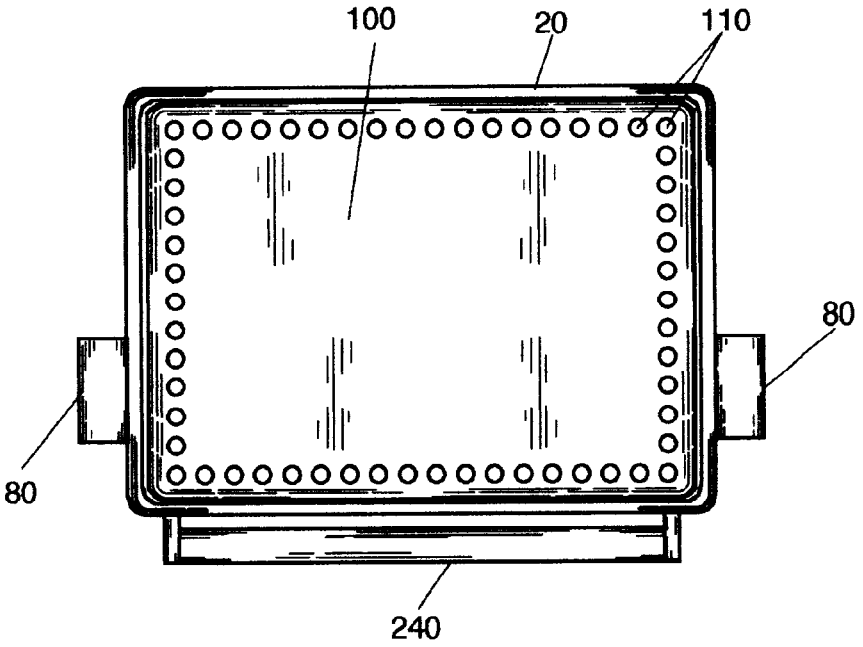
FIG. 2 is top view thereof.

Referring now to FIGS. 1 and 2, it is envisioned that located on the exterior surface of the main housing 20 are a plurality of foot pads 80. Each foot pad 80 is of generally horizontally elongated, rectangular configuration, extending outward laterally and horizontally from the bottom of the main housing 20, as an extension of the bottom, so as to facilitate the placement of a foot to secure the main housing 20 to the floor 85 during removal of the refuse liner 15.

A refuse volume 90 is formed from the bottom, side walls 50, anterior wall 60 and posterior wall 70, and is generally rectangular in configuration, with the opening of the refuse volume 90 being the open top 30.

Located inside of the refuse volume 90, near the bottom 40 of the main housing 20, is a support plate 100. The support plate 100 is a generally horizontally elongated member, of generally rectangular configuration, with vertical thickness sufficient to support a refuse liner 15 filled with garbage. The support plate 100 acts as an artificial bottom, supporting the refuse liner 15 above the bottom 40 of the main housing 20. It is envisioned that in order to facilitate assembly, removal, maintenance, and cleaning, the support plate 100 would be removably affixed within said refuse orifice 90 such that the plate 100 can be alternately detached and attached within the volume 90, thereby allowing full and free access to the bottom 40 of the main housing 20.

The cross sectional area of the support plate 100 is less than that of the bottom 40 of the main housing 20, such that the support plate 100 can slidable engage the interior surface of the side walls 50, anterior wall 60 and posterior wall 70, as the support plate 100 rises and lowers vertically during use.

Located along each outside edges of the support plate 100, on the upper surface of the support plate 100, are a linear series of equally spaced, vacuum holes 110. The radial center of each vacuum holes 110 is perpendicular to the plane formed by the support plate 100. Each vacuum hole 110 penetrates through the entire vertical thickness of the support plate 100. The diameter of each vacuum hole 110 is such, such that in combination, the vacuum holes 110 permit passage of air through the vacuum holes 110 to release the vacuum created between the refuse liner 15 and the interior surfaces of main housing 20 during removal of the refuse liner 15.

Figure 3:
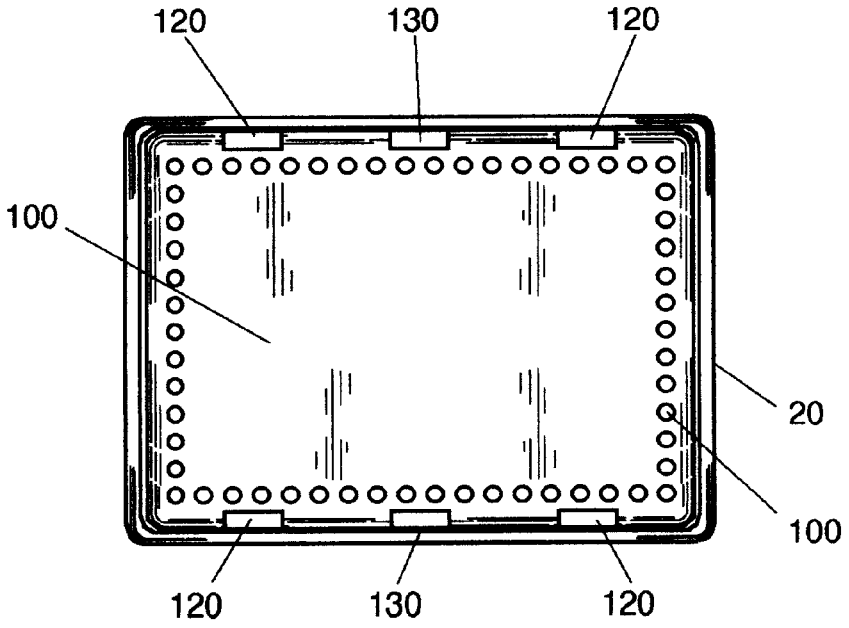
FIG. 3 is a cross sectional bottom view thereof, cut along lines III—III of FIG. 1.

Referring now to FIG. 3, located on both the interior surface of the anterior wall 60 and the posterior wall 70 of the main housing 20, near the lateral sides of the anterior wall 60 and posterior wall 70, are a set of support plate stands 120. Each support plate stand 120 is a horizontally elongated member of generally rectangular configuration, extending inward from the anterior wall 60 and the posterior wall 70. The support plate stands 120 are in horizontal planar alignment, and operate to support and stabilize the support plate 100 in its resting position.

Located on the anterior and posterior portions of the lower surface of the support plate 100 is a support plate guide 130. The support plate guides 130 are generally rectangular in configuration, and extend vertically, downward from the center edge of the anterior and posterior edges of the support plate 100, so as to be in the same plane as the anterior and posterior edges of the support plate 100. As such, the support plate guides 130 slidably engage the interior surfaces of the anterior wall 60 and posterior wall 70 of the main housing 20 respectively, and prevent the support plate 100 edge from binding or rotating against the interior surface of the anterior wall 60 and posterior wall 70 while the support plate 100 is being raised and lowered. The support plate guides 130 are positioned so as to not create mechanical interference with the support plate stands 120.

Figure 4:
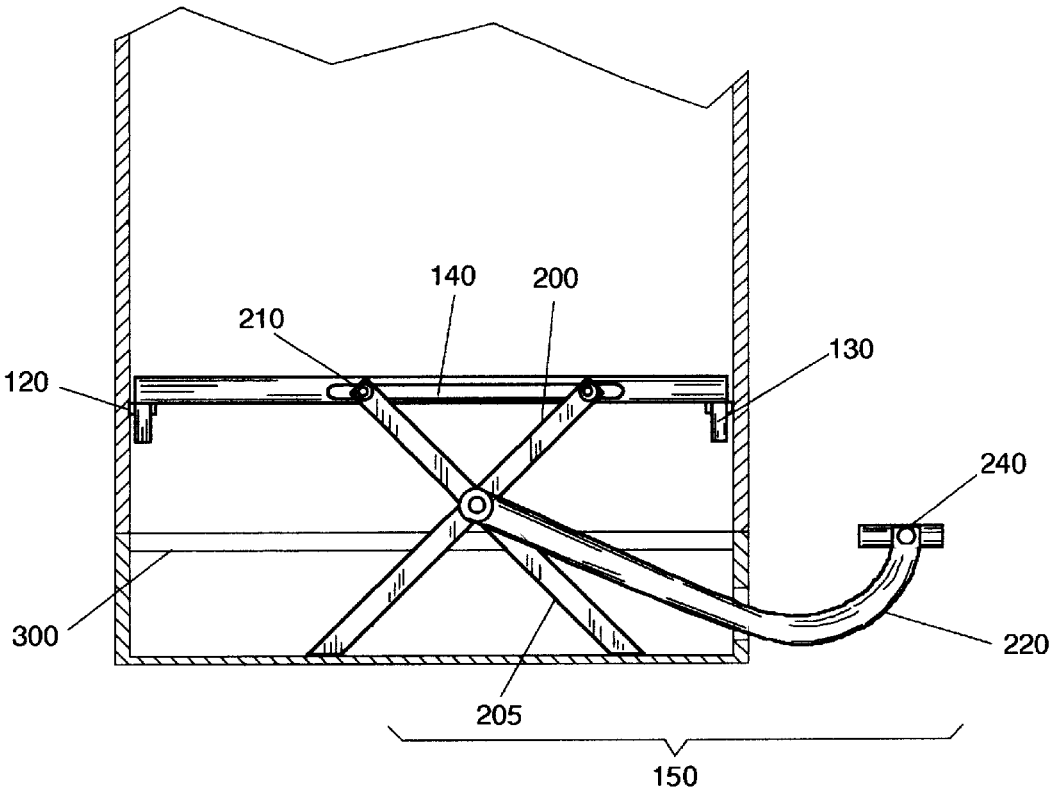
FIG. 4 is a left side, cross sectional view thereof, cut along lines IV—IV of FIG. 1, with mechanical components in the resting position.

Referring now to FIG. 4, located on the lower surface of the support plate 100, near the side walls 50, are a set of lifting slots 140. The lifting slots 140 are positioned parallel to the lateral edges of the support plate 100, parallel to each other, and parallel to the side walls 50. Each lifting slot 140 is generally cylindrical in configuration and horizontally elongated, extending almost the entire length of the support plate 100, terminating prior to reaching either the anterior or posterior edges of the support plate 100. Each lifting slot 140 is designed to permit a cylindrical object to slidably engage the lifting slot 140 while maintaining its position within the lifting slot 140.

Lifting force is provided by a lifting assembly 150. The lifting assembly 150 is comprised of a first internal arm 200 pivotally intersecting with a second internal arm 205 in a scissor-like manner. A fulcrum point 160 located in the approximate center of the internal arms 150. Each internal arm member is constructed of a strong, lightweight material, such as metal.

Figure 5:
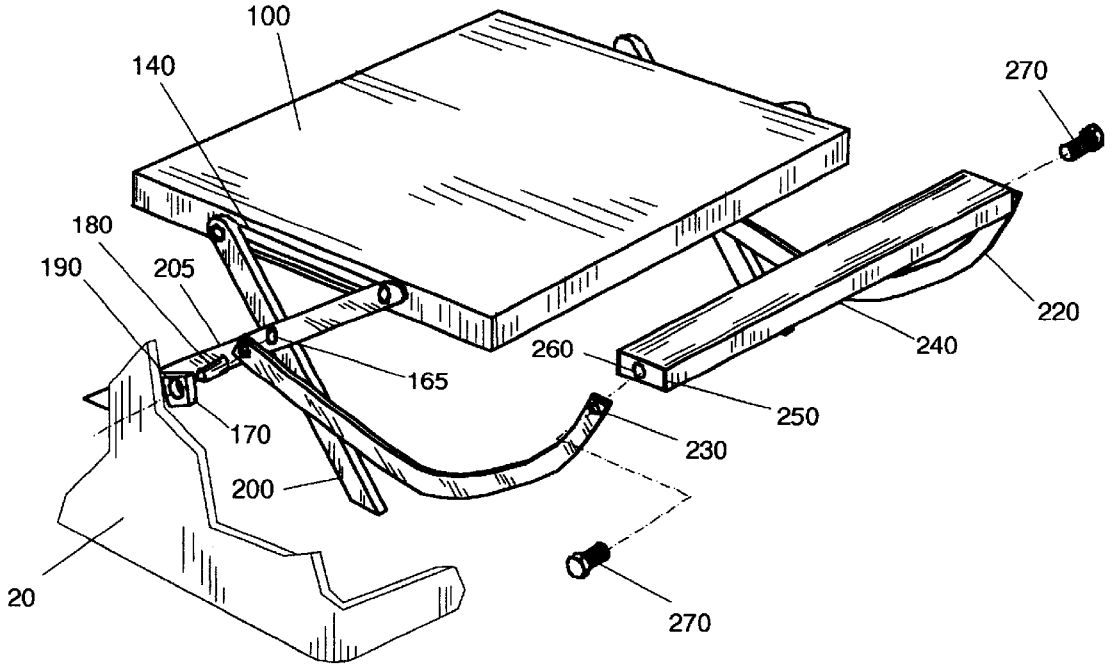
FIG. 5 is a front perspective view of the mechanical components thereof, removed from the main housing.

Referring now to FIG. 5, the fulcrum point on each lifting assembly 150 is creating by connecting the external arm 220 to the first internal arm 200 via a fulcrum protrusion 170. The fulcrum protrusion 170 is of generally cylindrical configuration, extending inward from the lower anterior interior surface of each side wall 50. The two fulcrum protrusions 170 are in horizontal linear alignment.

Located at the fulcrum point 160 on each lifting assembly 150 is a fulcrum hole 165, with radial center perpendicular to the plane created by the pivoting arm member 150. The cross sectional area of the fulcrum hole 165 is slightly greater than that of the fulcrum protrusion 170, such that the fulcrum protrusion 170 slidably engages the fulcrum hole 165.

Referring now to FIG. 4 and 5, each pivoting arm member 150 has an internal arm 200, located inside the refuse volume 90. The external arm 220 extends from the fulcrum point 160 toward the posterior wall 70 of the main housing 20, such that when the support plate 100 is in its resting position, the internal arm 200 terminates near the lower posterior edge of the support plate 100.

Connected to the end of each external arm 220, opposite the fulcrum point 160, is a foot bar 240. The foot bar 240 is of a horizontally elongated, linear configuration, extending laterally, parallel to the anterior wall 60 of the main housing 20, with two ends, each connecting to the end of an external arm 220, so as to form a horizontal surface area for a foot to press down upon. The foot bar 240 is constructed of a strong, lightweight material, such as metal or molded plastic.

Located on the lower surface of each end of the foot bar 240 is an external arm receiving orifice 250. Each external arm receiving orifice 250 is of a configuration similar to the end of the external arm 220 of the pivoting arm member 150, such that the end of each external arm 220 slidably engages the respective external arm receiving orifice 250 and rests inside of the external arm receiving orifice 250.

The external arm 220 is connected to the foot bar 240 through any of several traditional means of connection. The preferred embodiment discloses foot bar holes 260, located near the lateral ends of the foot bar 240. A foot bar retention means 270, such as a bolt, passes through the foot bar 240 and is threaded into the threaded hole 230 located on the end of each external arm 220.

Located on the upper surface of the foot bar 240 is a traction generating material 280, such as a series of parallel ribs extending from the upper surface. The traction generating material 280 is constructed of a strong, lightweight material, such as molded plastic.

Figure 6:
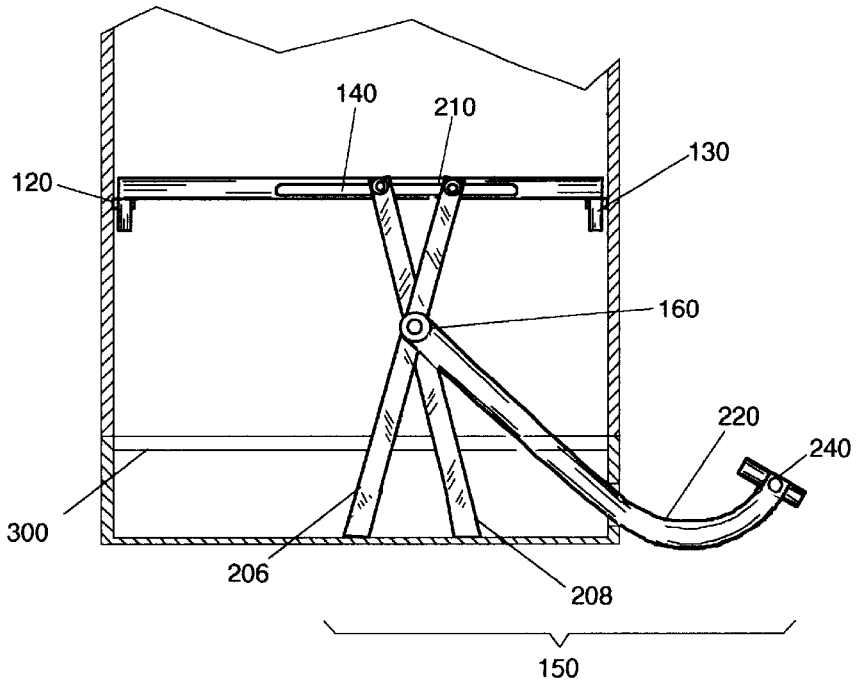
FIG. 6 is a left side, cross sectional view thereof, cut along lines IV—IV of FIG. 1, with mechanical components in the active position.

Referring now to FIG. 4 and 6, the foot bar 240, lifting assembly 150 and lifting slot 140 on the support plate 100 are designed such that when a foot presses down on the foot bar 240, the head portion 210 of the internal arm 200 slidably engages the lifting slot 140, sliding toward the anterior wall 60 of the main housing 20, thereby applying a vertical, upward force against the support plate 100, thereby raising the support plate 100, and assisting the operator to remove the refuse liner 15 from the main housing 20.

Figure 7:
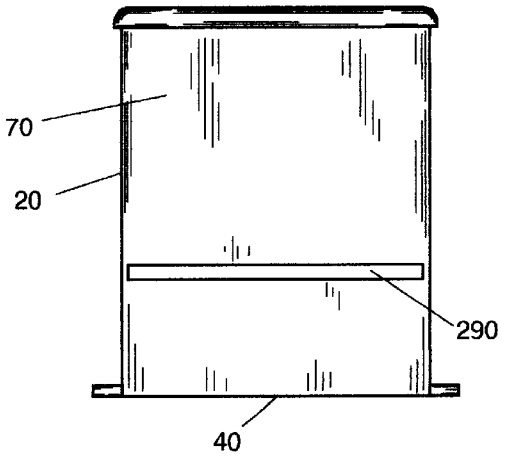
FIG. 7 is a rear view of the preferred embodiment thereof.

Referring now to FIG. 7, located along the lower portion of the posterior wall 70 of the main housing 20 is a horizontally elongated removable tray orifice 290 of generally rectangular configuration. The removable tray orifice 290 extends laterally almost the entire lateral distance of the posterior wall 70, and is positioned below the resting position of the support plate 100.

2. Operation of the Preferred Embodiment

Figure 8:
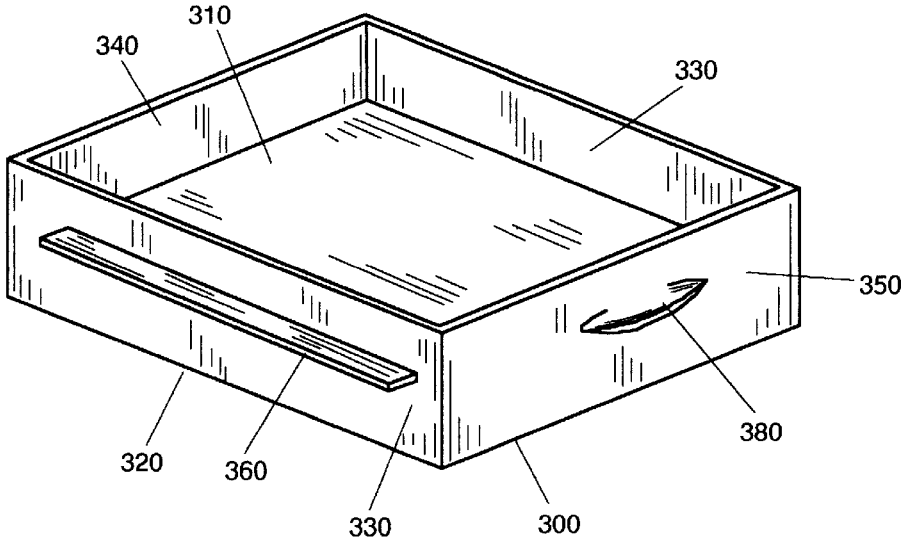
FIG. 8 is a front perspective view of the preferred embodiment in use.
Figure 9:
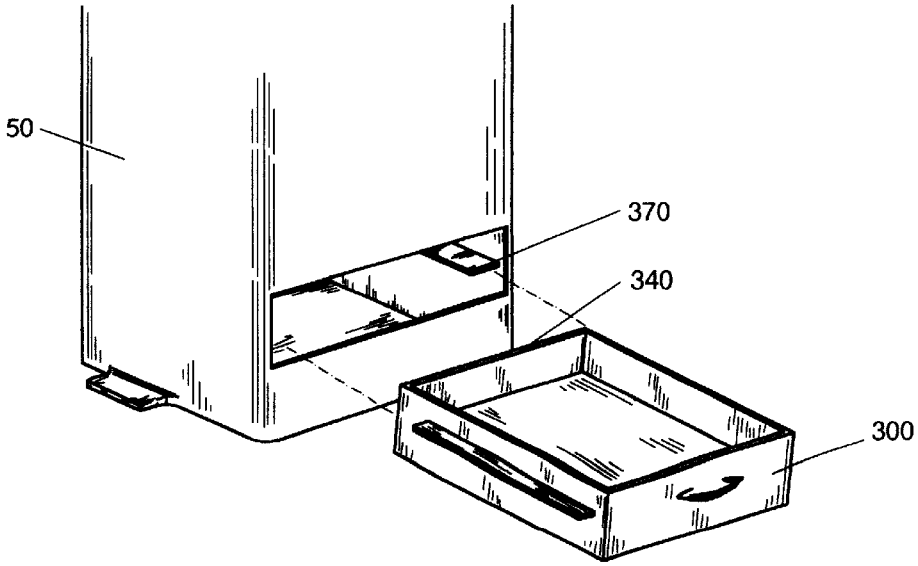
FIG. 9 is a left side exploded view of the removable tray in the main housing.
Figure 10:
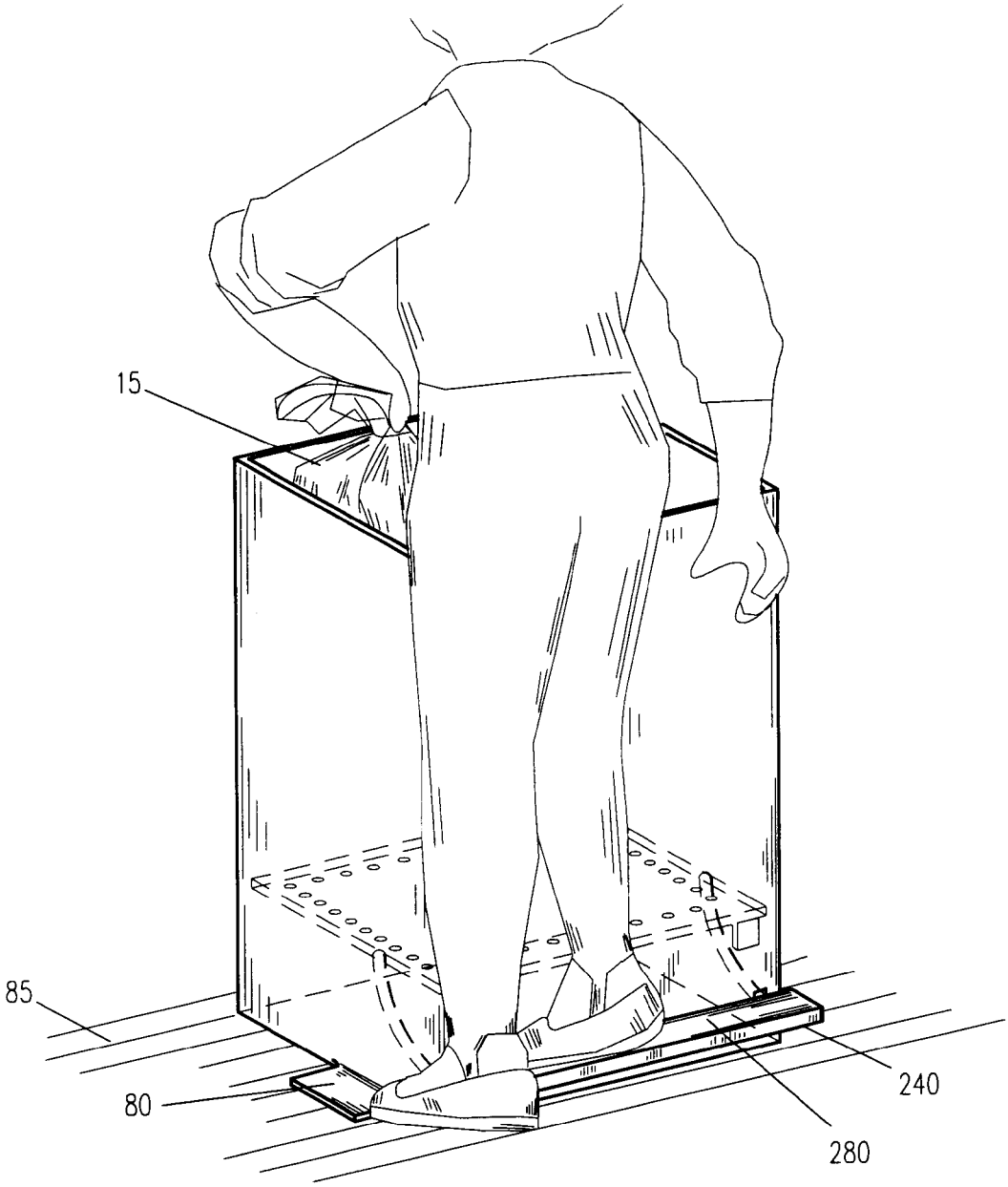
FIG. 10 is a front perspective view of the preferred embodiment in use.

Referring now to FIG. 8, to use the present invention, first, the operator places a refuse liner 15 inside the main housing 20, as with conventional refuse containers. Second, when the refuse liner 15 is full, the operator places his or her foot on the corresponding foot pad 80, thus holding the main housing 20 against the ground. Third, the operator places his or her other foot on the foot bar 240 and presses down with his or her foot. This action causes the pivoting arm member 150 to pivot about the fulcrum point 160, with the head portion 210 placing upward vertical force on the lifting slot 140 of the support plate 100. The head portion 210 slidably engages the lifting slot 140, moving toward the anterior wall 60 of the main housing 20, with the resulting action lifting the support plate 100 and the refuse liner 15 located on the support plate 100. Vacuum created between the refuse liner 15 and the interior surfaces of the side walls 50, anterior walls 60 and posterior walls 70 is eliminated by air passing through the vacuum holes 110 located on the support plate 100. Fourth, the operator lifts the refuse liner 15 out of the main housing 20, ties the refuse liner 15 closed, and places another refuse liner 15 in the main housing 20 in the traditional manner.

The foregoing description is included to illustrate the operation of the preferred embodiment and is not meant to limit the scope of the invention. The scope of the invention is to be limited only by the following claims.

What is claimed is:

1. A step and lift refuse liner removal system, said liner removal system comprising:

a main housing of a vertically elongated, upstanding rectangular configuration, having an internal surface and an external surface, said main housing having an open top and a closed bottom, and generally impervious side walls, an anterior wall and a posterior wall, forming a receptacle for receiving a traditional refuse liner that holds trash or debris therein;

a refuse volume formed from said bottom, side walls, anterior wall and posterior wall, said refuse volume being generally rectangular in configuration, with an opening of said refuse orifice being said open top;

a support plate of generally horizontally elongated, rectangular configuration, having an upper surface, a lower surface, and four edges, said support plate being located inside of said refuse orifice, near said bottom of said main housing, and used to support said refuse liner above said bottom of said main housing; wherein said support plate functions as an artificial bottom, supporting said refuse liner above said bottom of said main housing, with a cross sectional area less than that of said bottom of said main housing, such that said support plate can slidable engage said interior surface of said side walls, anterior wall and posterior wall, as said support plate rises and lowers vertically during use, and a lift assembly, said lift assembly designed to provide vertical force against said support plate to lift said support plate and said refuse liner resting on said support plate by application of downward force of a human foot.

2. The liner removal system described in claim 1, wherein said main housing is further comprised of a plurality of foot pads of generally horizontally elongated, rectangular configuration, said foot pads being located on the exterior surface of said main housing extending outward laterally and horizontally from said bottom of said main housing, as an extension of said bottom, so as to facilitate the placement of a foot to secure said main housing to the floor during removal of said refuse liner.

3. The liner removal system described in claim 1, wherein said support plate is further comprised of vacuum holes, said vacuum holes located along the outside edges of said support plate in linear series such that said vacuum holes permit passage of air through said vacuum holes to release the vacuum created between said refuse liner and said interior surfaces of main housing during removal of said refuse liner.

4. The liner removal system described in claim 1, wherein said main housing further comprises a plurality of horizontally elongated support stands of generally rectangular configuration, said support stands being formed from said interior surface of said anterior wall and said posterior wall, and extending inward, perpendicular to said anterior wall and said posterior wall, in horizontal planar alignment, operating to stabilize said support plate.

5. The liner removal system described in claim 1, wherein said support plate is further comprised of a set of support plate guides of generally rectangular configuration, said support plate guides located on said anterior and posterior portions of said lower surface of said support plate, and extend vertically, downward from a center edge of the anterior and posterior edges of said support plate, so as to slidably engage said interior walls of said main housing, and prevent the support plate edges from binding or rotating against the interior surface of the anterior wall and posterior wall while said support plate is being raised and lowered.

6. The liner removal system described in claim 1, wherein said support plate is further comprised of a set of parallel lifting slots of generally elongated configuration, said lifting slots being located on said lower surface of said support plate, near said side walls, parallel to said side walls, extending almost the entire distance of said support plate, terminating prior to reaching either the anterior or posterior edges of said support plate.

7. The liner removal system described in claim 1, wherein said lift assembly is further comprised of:

a lifting assembly comprised of a first internal arm pivotally intersecting with a second internal arm in a cross connected manner at a fulcrum point located in the approximate center of the internal arms and configured and operating in the vertical plane parallel to said side walls and each other; and a foot bar of generally elongated, linear configuration, having an upper surface and a lower surface, said foot bar connected to the end of said first internal arm and second internal arm that extends beyond said refuse orifice, extending laterally, parallel to said anterior wall of said main housing, with two ends, each connecting to the end of said external arm, so as to form a horizontal surface area for a foot to press down upon, with a traction generating material located on the upper surface of said foot bar.

8. The liner removal system of claim 7, wherein said first internal arm and said second internal arm are constructed of a strong, lightweight metal.

* * * * *